US006443411B1

(12) United States Patent
Merriweather, Jr.

(10) Patent No.: US 6,443,411 B1
(45) Date of Patent: Sep. 3, 2002

(54) FLOOR ANCHOR BRACKET FOR PILASTER

(75) Inventor: Frank Merriweather, Jr., Carson, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 0 days.

(21) Appl. No.: 09/238,209

(22) Filed: Jan. 27, 1999

(51) Int. Cl.[7] ..... A47H 1/10
(52) U.S. Cl. ..... 248/300; 248/354.4
(58) Field of Search ..... 248/200, 300, 248/218.4, 247, 354.4; 52/34, 35, 238.1, 702, 715, 259.96

(56) References Cited

U.S. PATENT DOCUMENTS 298,463 A * 5/1884 Guedle
3,669,480 A * 6/1972 Fugate ..... 287/20.95
4,192,406 A * 3/1980 Mitchell ..... 182/185
D275,264 S * 8/1984 Wegener, ll ..... D8/373
4,594,017 A * 6/1986 Hills
4,717,279 A * 1/1988 Commins ..... 403/187
5,092,097 A * 3/1992 Young ..... 52/702
5,183,332 A * 2/1993 Gale ..... 248/220.2
5,217,317 A * 6/1993 Young ..... 403/232.1
5,394,668 A * 3/1995 Lim
5,417,401 A * 5/1995 Thompson et al. ..... 248/674
5,560,156 A * 10/1996 McDonald ..... 52/92.2
5,660,011 A * 8/1997 Bleeker et al. ..... 52/239
5,678,379 A * 10/1997 Quattrociocchi ..... 52/712
5,970,677 A * 10/1999 Masters et al.

OTHER PUBLICATIONS

JACKNOB CORP., Catalog #967, (undated), p. 19, showing devices which were on sale in this county more than one year prior to the date of the application for patent in the United States.

* cited by examiner

*Primary Examiner*—Korie Chan
(74) *Attorney, Agent, or Firm*—Christie, Parker & Hale, LLP

(57) ABSTRACT

A pilaster assembly for bathroom partitions comprising a pilaster, a vertically oriented end wall with an upper surface and an inner face, and two vertical side walls, perpendicular to and extending laterally relative to the inner face of the end wall, with each side wall having an upper end and an inner face. The inner faces of the side walls are substantially parallel and spaced sufficiently apart to receive a pilaster, and the upper surface of the side walls is higher than the upper surface of the end wall. The pilaster is received between the side walls, with the bottom of the pilaster vertically supported by the upper surface of the end wall.

17 Claims, 6 Drawing Sheets

—PRIOR ART—

FLOOR ANCHOR BRACKET FOR PILASTER

FIELD OF THE INVENTION

The invention relates to floor anchor brackets for anchoring a bathroom partition pilaster to a floor surface, specifically a pilaster attachment bracket for connecting a pilaster to a surface anchor.

BACKGROUND OF THE INVENTION

Subdividing walls and individual compartments in bathrooms and washrooms are generally not standard construction built-out walls, but instead are a collection of vertical bathroom partitions that are installed after the room has been finished. In order to provide adequate stability and support, these bathroom partitions are attached to a vertical support column, known as a stile or pilaster. The bathroom partitions are usually attached by brackets to a pilaster, in a plane perpendicular to the pilaster. Even when one end of a bathroom partition is mounted to a traditional wall, the other end generally terminates at a pilaster. Pilasters are also used to frame doors in bathroom compartments, with the door mounted in line with two pilasters. Pilasters are generally anchored to the floor, hung from the ceiling, or both.

There are several types of anchors available for attaching such pilasters to the floor. The most simple are single-piece brackets, where a single bracket anchors a pilaster to the floor. This type of bracket is generally a metal "L" shaped bracket, with one leg of the "L" anchored to the floor, and the other leg of the "L" attached to one side of the pilaster.

While this bracket features simplicity, it lacks adjustability. Also, as the bracket is located on only one side of the pilaster, it has a limited ability to withstand side loading. Side loading is important for two main reasons: First, under standard loading conditions, bathroom partitions are attached to and extend perpendicularly from a pilaster, creating a side load on the pilaster. Second, bathroom compartments are often subject to vandalism, including kicking and other forces acting on both the bathroom partitions and the pilasters, which in turn create large lateral loads on the pilaster.

A U-shaped pilaster anchor bracket is also known, with a horizontal surface parallel to the floor, anchored to the floor, and two parallel vertical sides, which extend upward on either side of the pilaster. The pilaster is set in the bracket and attached by screws which extend through holes in the vertical sides of the bracket. Although this bracket provides improved lateral stability over the previously described bracket, it still does not provide flexibility and adjustability in installation.

Dual brackets are also known, where each pilaster is anchored by two separate brackets. Generally, these brackets are "L" shaped, with the horizontal leg of the "L" anchored to the floor, and the vertical leg attached to the narrow end wall of the pilaster, often through a slot in the vertical leg.

Although providing some degree of horizontal flexibility and adjustability, this type of dual bracket does not offer vertical flexibility, as once the horizontal and vertical legs of the bracket are attached to the floor and pilaster respectively, there is no way to vertically adjust the bracket with respect to either the floor or the pilaster. In addition, because this bracket connects only to the narrow end walls of the pilaster, any lateral forces along the sides of the pilaster are borne entirely by the screws attaching to the end wall, making failure more likely under the typical side loading discussed previously.

Finally, the use of dual two-piece brackets is also known. Generally, the horizontal leg of an "L" shaped bracket is attached to the floor, while the vertical leg provides an attachment point for the second bracket. The second bracket is also generally "L" shaped, with the horizontal leg attaching to the bottom of the pilaster, and the vertical leg attaching to the vertical leg of the first "L" shaped bracket. Two such two-piece brackets are used to attach each pilaster.

These brackets attach to the bottom of the pilaster, with screws attached in what is generally unfinished particle board. The pilaster acts as a moment arm, and even a small lateral load near the upper end of a pilaster produces great torque at the base of the pilaster, which can cause the pilaster to pull out from the screws. As the screws in the end of the pilaster are the only portion of the anchor bracket keeping the pilaster from pulling away from the floor, any lateral force is effectively transmitted directly to the screws, and thus failure, with the screws and the pilaster pulling apart, is not uncommon.

Additionally, these "L" shaped brackets generally require flanges at the vertex of the "L", as the load from the pilaster is transmitted to the horizontal portion of a bracket rather than directly down the vertical portion, creating torque about the vertex of the bracket, and requiring rigidity within the bracket. This rigidity requirement, usually requiring a brace or flange at the vertex of the bracket, increases the manufacturing cost of the "L" shaped bracket.

In view of the above, it should be appreciated that there is still a need for a floor anchor bracket for a pilaster providing increased lateral support, decreased material costs and a stronger and more substantial attachment to the pilaster, while still providing horizontal and vertical adjustability and flexibility in installation. The present invention satisfies these and other needs and provides further related advantages.

SUMMARY OF THE INVENTION

The present invention is embodied in a pilaster assembly for bathroom partitions providing increased lateral support, stronger and more substantial attachment to a pilaster, horizontal and vertical adjustability and flexibility in installation, and decreased material costs. The pilaster assembly includes a vertically oriented end wall, with an upper surface and an inner face, and two vertical side walls, perpendicular to and extending laterally relative to the inner face of the end wall, with each side wall having an upper end and an inner face. The inner faces of the side walls are parallel and spaced sufficiently apart to receive a pilaster, and the upper surface of the side walls is higher than the upper surface of the end wall. The pilaster is received between the side walls, with the bottom of the pilaster vertically supported by the upper surface of the end wall.

A feature of the present invention is its parallel vertical side walls, which straddle the pilaster. These side walls provide increased lateral stability. The previously known upper bracket portion attached to the pilaster through the unfinished bottom of the pilaster, and thus lateral or tensile loading was transmitted directly to the screws. In the present invention, the vertical sidewalls receive the majority of side loading, greatly reducing the load directly on the screws. Further, in the present invention, the screw or screws attaching the bracket to the pilaster are oriented horizontally, and thus any side load transmitted to the screws is along the axis of the screws, where the screws are designed to be loaded, rather than a load perpendicular to the screws, as in the prior bracket.

Another feature of the present invention is that the screws attaching the anchor to the pilaster attach through the finished side surface of the pilaster, which is generally a laminate layer. This provides increased holding ability for the screws, as the laminate or finished side surface of the pilaster is much more durable than the unfinished particle board that generally comprises the end of a pilaster, and is much more resistant to a tensile type load.

Another feature of the present invention is reduced material costs. The bracket is designed to be made from a single piece of material, which allows the bracket to be stamped from a flat sheet, then bent into form. The pattern of the brackets on the sheet allows the brackets to be stamped in a progressive die, where the flat bracket patterns are aligned end to end, reducing waste. Because the vertical end wall of the bracket provides direct vertical support to the pilaster, there is no need to provide braces or flanges to strengthen the bracket, simplifying the manufacture of the bracket, reducing costs and saving time. Further, the present invention requires only one screw to attach the pilaster to the upper portion of the bracket, and thus uses fewer screws than presently known two-piece brackets.

Other features and advantages of the present invention will become apparent from the following description of the preferred embodiments, taken in conjunction with the accompanying drawings, which illustrate, by way of example, the principles of the invention.

BRIEF DESCRIPTION OF THE DRAWINGS

The details and features of the present invention may be more fully understood by referencing the detailed description and drawings, in which.

DETAILED DESCRIPTION

Figure 1:
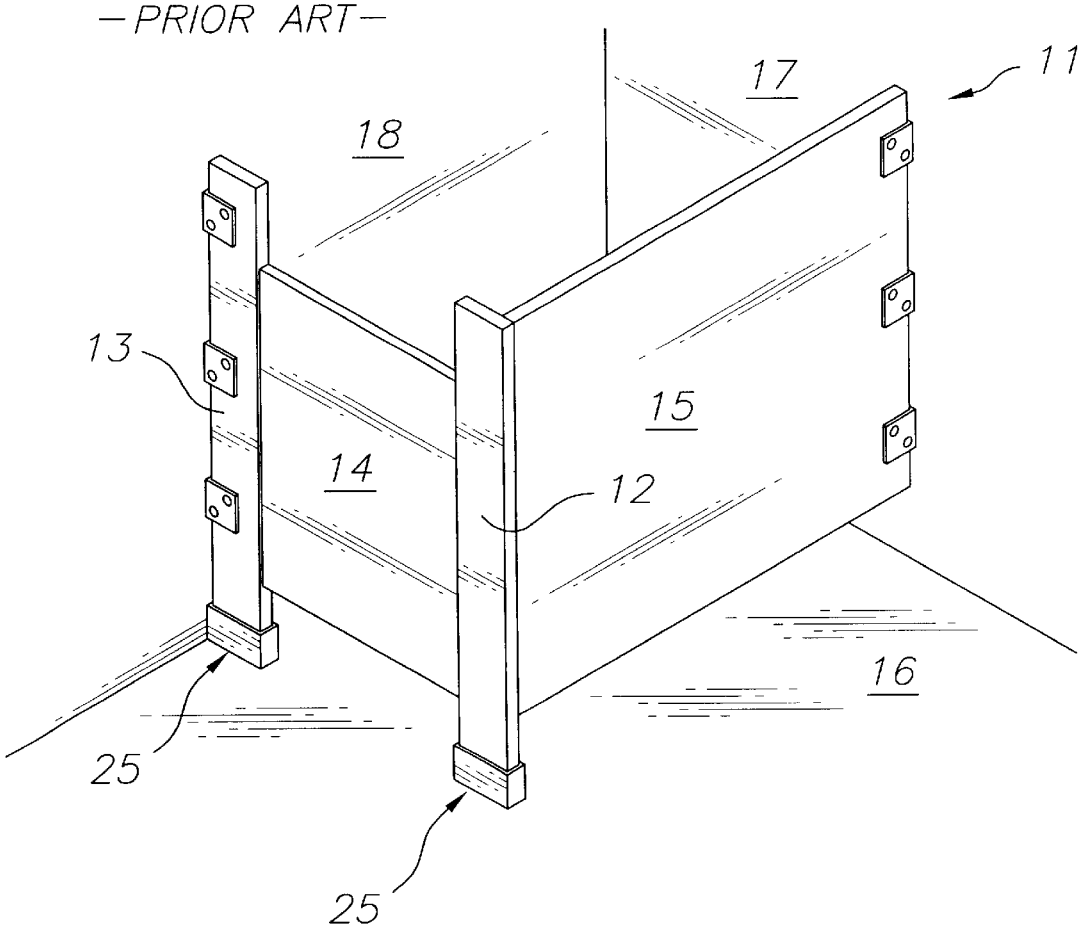
FIG. 1 is a perspective view illustrating a typical bathroom compartment with pilasters, a partition and a door, and showing the connection of a pilaster to the floor.
Figure 3:
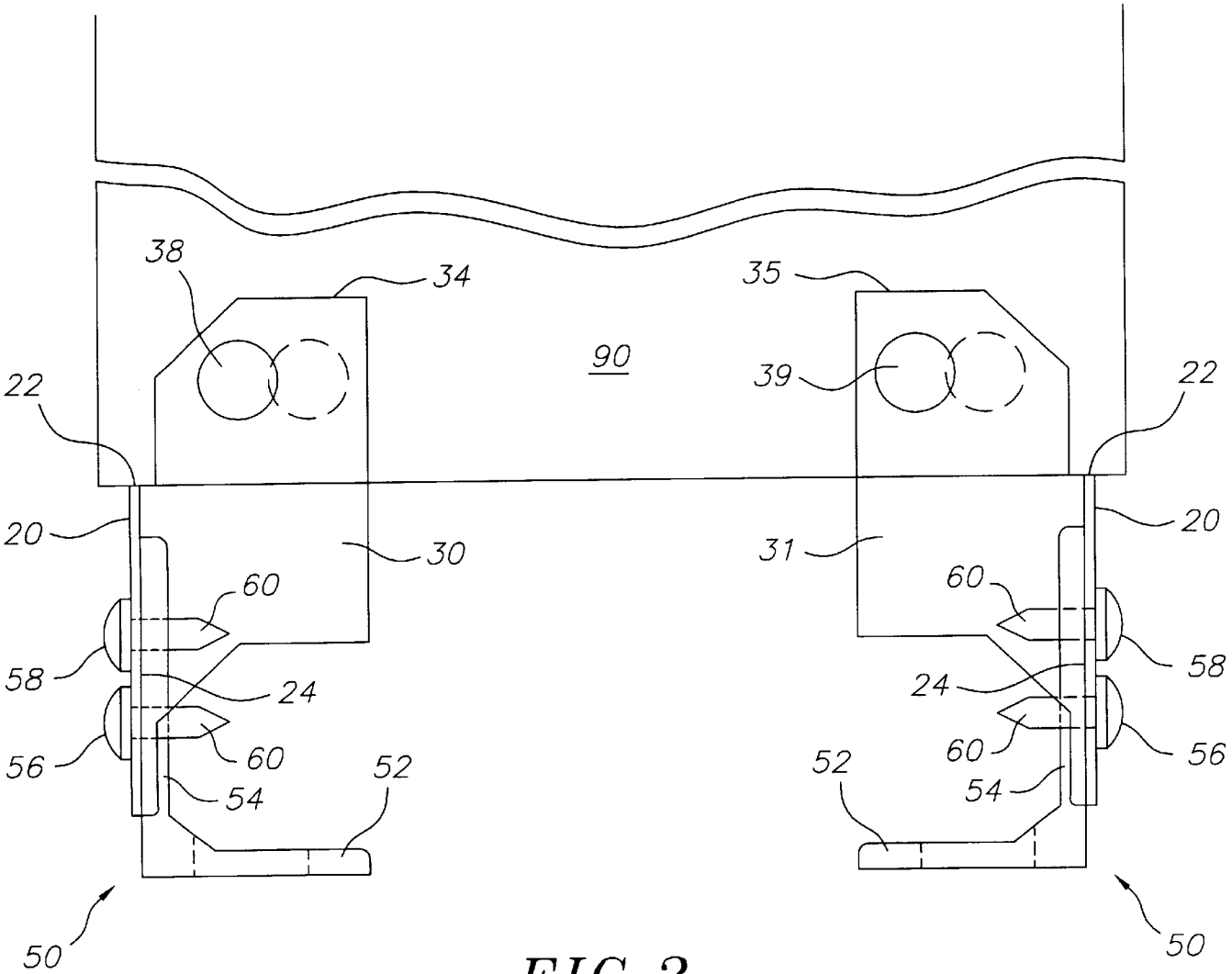
FIG. 3 is a front view of one embodiment of the pilaster bracket of the present invention, showing its connection with a surface anchor and its attachment to a pilaster in phantom.

A conventional bathroom compartment 11, with pilasters 12, 13, a door 14 and a partition 15 is shown in FIG. 1. Such a compartment 11 is well known from U.S. Pat. No. 5,671,097 which is incorporated herein by reference. The pilasters 12, 13 are fastened to the floor using a pilaster bracket of the present invention as shown in FIG. 3. This bracket is located underneath and enclosed by a shoe 25. The partition 15 is connected between the pilaster 12 and the back wall 17 with conventional mounting brackets. The pilaster 13 is similarly fastened to the side wall 18. The door 14 is hinged to the pilaster 13 in the conventional manner.

Figure 2:
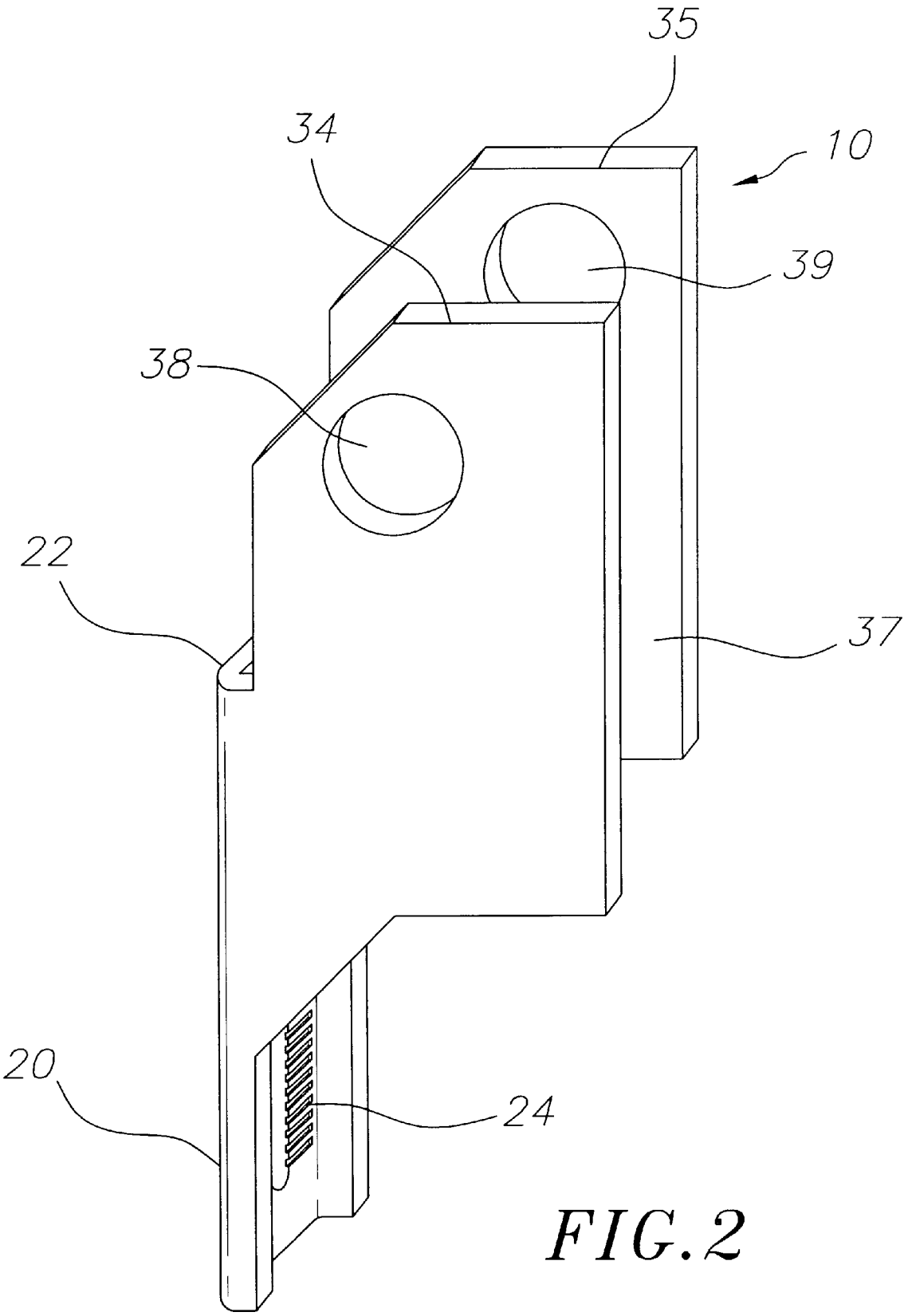
FIG. 2 is a perspective view of one embodiment of the pilaster bracket of the present invention.
Figure 4:
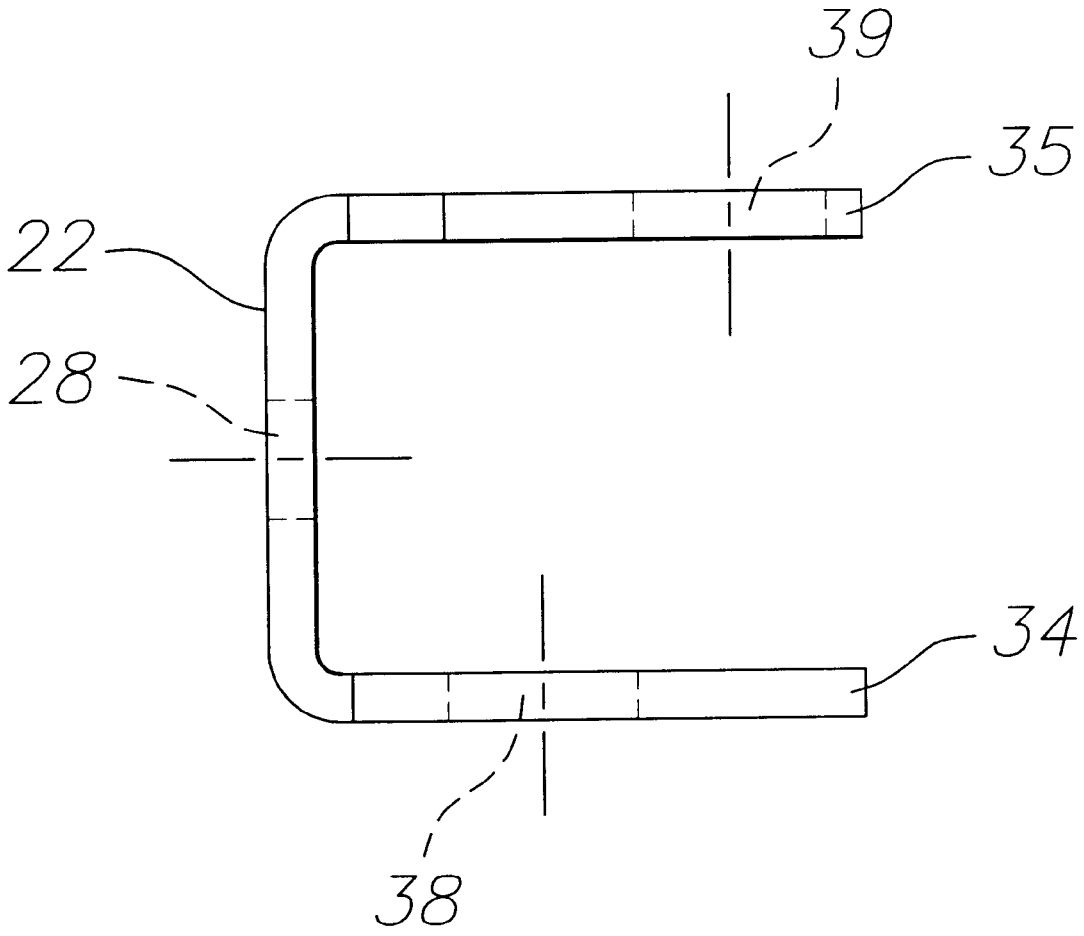
FIG. 4 is a top view of the pilaster bracket of FIG. 2.
Figure 5:
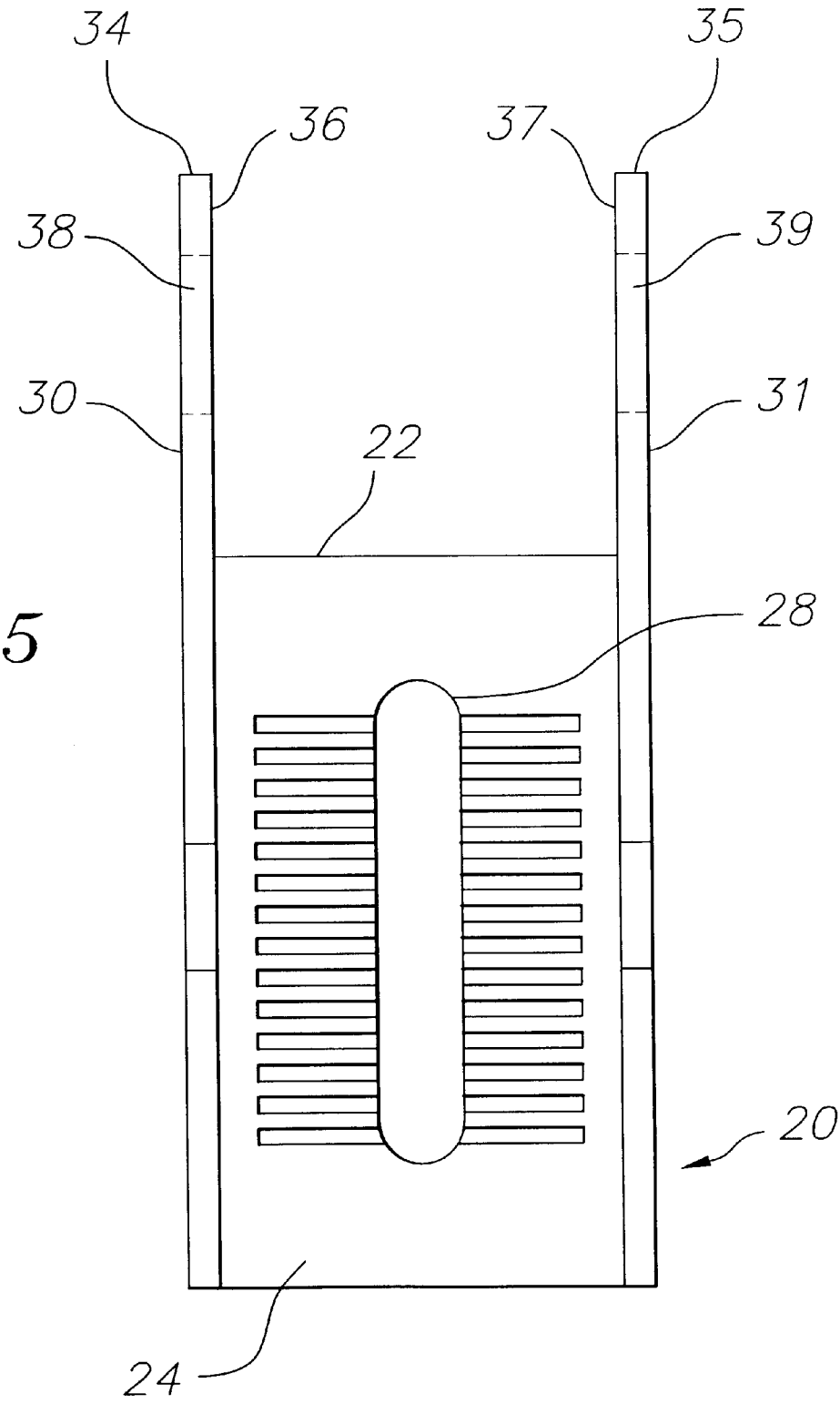
FIG. 5 is an end view of the pilaster bracket of FIG. 2.

A pilaster attachment bracket 10 according to the present invention is shown in FIGS. 2 through 4. The bracket has a vertically oriented end wall 20, with an upper surface 22, and an inner face 24. Extending laterally from the inner face 24 of the end wall 20 are parallel vertical side walls 30, 31. Each side wall 30, 31 has an upper surface 34, 35, and an inner face 36, 37. The inner faces 36 and 37 are substantially parallel to each other, as are the side walls 30 and 31. Preferably, the side walls 30 and 31 are substantially perpendicular to the end wall 20, and thus the inner faces 36 and 37 of the side walls 30 and 31 are substantially perpendicular to the inner face 24 of the end wall 20. The upper surfaces 34 and 35 of the side walls 30 and 31 are above the upper surface 22 of the end wall 20.

With reference to FIG. 3, when the pilaster attachment bracket 10 is in use, a pilaster 90 is received between the vertical side wall 30 and 31, and the bottom surface of the pilaster abuts the upper surface 22 of the end wall 20. The side walls 30 and 31 each have a bore 38 and 39 through the wall, preferably located above the height of the upper surface 22 of the end wall 20, to receive a fastener (not shown) for attachment to the pilaster 90. It will be appreciated that while a two screw offset attachment configuration is disclosed, various other configurations may be utilized. For example, only one of the side walls 30 and 31 could be attached to the pilaster 90 by a single screw, or the side walls 30 and 31 could be attached by a bolt, rivet, lynch pin, rod and cotter pin, bar or other attachment means known to one skilled in the art. In addition the bores 38 and 39 could be offset from each other in any direction to permit two fasteners to be secured to the pilaster, or could be aligned to facilitate the use of a rod or bolt for attachment. Preferably, the pilaster 90 is supported by the upper surface 22 of the end wall 20. The end wall 20 defines a vertical slot 28, for accepting fasteners 60 to attach the end wall to a floor anchor bracket. It will be appreciated that while an end wall with a single slot is disclosed, other configurations might be utilized, such as an end wall with a plurality of holes, or multiple smaller slots. Additionally, in the preferred embodiment, the inner face 24 of the end wall 20 has one or more protrusions or notches to frictionally interface with a mating floor anchor.

An "L" shaped floor anchor bracket 50 has a horizontal leg 52 and a vertical leg 54. The horizontal leg 52 is attached to the floor by screw or other attachment means (not shown). The vertical leg 54 preferably provides two vertically aligned holes, 56 and 58, for attaching the floor anchor bracket to the pilaster attachment bracket 10. In the preferred embodiment, the vertical leg 54 also has an outer face 59, which has one or more mating protrusions or notches to frictionally interface with the inner face 24 of the end wall 20 of the pilaster attachment bracket 10. The vertical leg 54 of the floor anchor 50 is attached to the end wall 20 by screws 60 through holes 56 and 58 and received by slot 28 in the end wall. It will be appreciated that alternatives to screw attachment may also be used, as discussed previously with regard to attaching the pilaster attachment bracket 10 to the pilaster 90 through the bores 38 and 39 in the side walls 30 and 31.

The pilaster attachment bracket of the present invention provides increased lateral support, with vertical side walls that attach on both sides of the pilaster. The pilaster attachment bracket attaches through the finished sides of the pilaster, providing greater attachment strength than attachment through the unfinished end of the pilaster. The increased strength and support of the pilaster attachment bracket is accomplished at a reduced material cost by using dual two piece brackets, rather than a solid, single-piece bracket, with the dual, two-piece brackets also providing horizontal and vertical adjustability and flexibility in installation.

Figure 6:
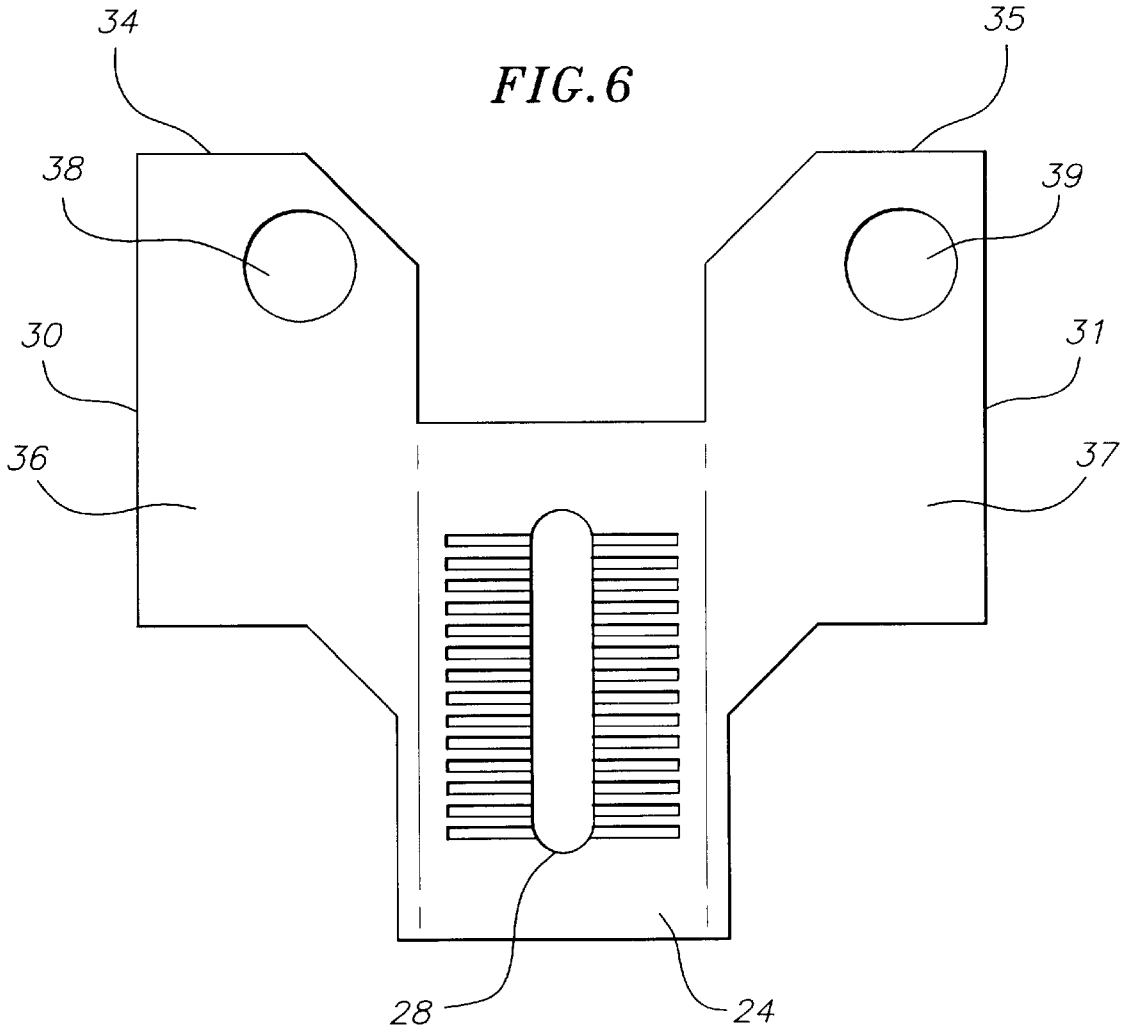
FIG. 6 is a plan view of the pilaster bracket in sheet form before stamping and bending into its preferred embodiment.

With reference to FIG. 6, the pilaster bracket is preferably designed to be formed from a single sheet of material, allowing it to be manufactured by stamping it out of a single sheet of material and bending it into form. This reduces production and material costs, as well as reducing the amount of time required to produce the pilaster bracket.

Although the invention has been described in detail with reference only to the preferred embodiments, those having ordinary skill in the art will appreciate that various modifications can be made without departing from the spirit and scope of the invention. Accordingly, the invention is defined with reference to the following claims.

What is claimed is:

1. A pilaster assembly for a bathroom partition, comprising:

a vertically extending support pilaster for supporting bathroom partitions and doors the pilaster having a bottom surface, and an attached bracket having a vertically oriented end wall including an upper surface and an inner face, and two vertically oriented side walls, each side wall extending laterally from the inner face of the end wall, in a plane substantially perpendicular to the end wall, each side wall having an upper surface and an inner face;

wherein the inner faces of the side walls are substantially parallel and spaced sufficiently apart to receive the pilaster;

wherein the pilaster is located between the side walls of the attached bracket, the bottom surface of the pilaster is supported on the upper surface of the end wall and the upper surfaces of the side walls are located higher than the upper surface of the end wall.

2. An assembly as in claim 1, further comprising:

a surface anchor, having a horizontal base member and a vertical member, substantially perpendicular to the horizontal base member, the vertical member having an outer face;

wherein the horizontal base member is configured for attachment to a mounting surface, and the outer face of the vertical member and the inner face of the end wall are configured for locking engagement with each other.

3. An assembly as in claim 2, wherein the inner face of the end wall has one of a protrusion or recess and the outer face of the vertical member of the surface anchor has the other of a protrusion or recess to provide the locking engagement.

4. An assembly as in claim 1, wherein the side walls have a lower surface below the upper surface of the end wall.

5. An assembly as in claim 1, wherein both side walls extend inwardly relative to the inner face of the end wall.

6. An assembly as in claim 1, wherein the end wall and side walls are formed from a single continuous piece of material.

7. An assembly as in claim 1, wherein the end wall and side walls are formed from a single piece of metal, allowing them to be manufactured by stamping.

8. An assembly as in claim 1, wherein one side wall has a bore, at an elevation above the upper surface of the end wall, configured to receive a fastener for attachment to a pilaster.

9. An assembly as in claim 1, wherein each side wall has a bore, at an elevation above the upper surface of the end wall, configured to receive a fastener for attachment to a pilaster.

10. An assembly as in claim 1, wherein the end wall has a vertical slot configured to receive one or more fasteners for attachment to a surface anchor.

11. An assembly as in claim 1, wherein the side walls extend from the end wall at a location below the upper surface of the end wall.

12. An assembly as in claim 11, wherein the end wall and side walls are formed from a single piece of material and the side walls extend from the side edges of the end wall such that the bracket may be formed from a stamped piece of material.

13. A pilaster assembly for a bathroom partition, comprising:

a vertically extending support pilaster for supporting bathroom partitions and doors;

a bracket having a vertically oriented end wall having an upper surface and an inner face, two vertically oriented side walls, extending laterally from the inner face of the end wall, in a plane substantially perpendicular to the end wall, each side wall having an upper surface and an inner face, wherein the inner faces of the side walls are substantially parallel and spaced sufficiently apart to receive the pilaster while the pilaster is supported on the upper surface of the end wall and the upper surfaces of the side walls are located higher than the upper surface of the end wall, wherein the end wall and side walls are formed from a single flat sheet of metal, allowing them to be manufactured by stamping;

a surface anchor having a horizontal base member and a vertical member substantially perpendicular to the horizontal base member, the vertical member having an outer face, wherein the horizontal base member is configured for attachment to a mounting surface, and the outer face of the vertical member and the inner face of the end wall each have one of a protrusion or recess for engagement with each other.

14. An assembly as in claim 13, wherein both side walls extend inwardly relative to the inner face of the end wall.

15. An assembly as in claim 13, wherein one side wall has a bore, at an elevation above the upper surface of the end wall, configured to receive a fastener for attachment to said pilaster.

16. An assembly as in claim 13, wherein the end wall has one or more openings configured to receive one or more fasteners for attachment to the surface anchor.

17. A pilaster assembly for a bathroom partition, comprising:

a vertical support pilaster for supporting bathroom partitions and doors;

a pilaster bracket having a vertically oriented end wall having an upper surface and an inner face, and two vertically oriented side walls, extending laterally from the inner face of the end wall, in a plane substantially perpendicular to the end wall, each side wall having an upper surface and an inner face; and a surface anchor, having a horizontal base member and a vertical member, substantially perpendicular to the horizontal base member, the vertical member having an outer face;

wherein the inner faces of the side walls are substantially parallel and spaced sufficiently apart to receive the pilaster, each side wall has a bore at an elevation above the upper surface of the end wall, configured to receive a fastener for attachment to the pilaster, and the upper surfaces of the side walls are located higher than the upper surface of the end wall;

wherein the horizontal base member of the surface anchor is configured for attachment to a mounting surface, and the outer face of the vertical member and the inner face of the end wall each have one of a protrusion or recess for locking engagement with each other;

wherein the pilaster is supported on the upper surface of the end wall.

* * * * *